US008771384B2

(12) United States Patent
Sloan

(10) Patent No.: US 8,771,384 B2
(45) **Date of Patent: *Jul. 8, 2014**

(54) UNIVERSAL SYNTHETIC DIESEL FUEL ADDITIVE PRODUCT-BY-PROCESS TO REPLACE THE LOST SULFUR LUBRICATION WHEN USING LOW-SULFUR DIESEL FUELS

(71) Applicant: BestLine International Research, Inc., Schenectady, NY (US)

(72) Inventor: Ronald J. Sloan, Blaine, WA (US)

(73) Assignee: Bestline International Research, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/946,074

(22) Filed: Jul. 19, 2013

(65) Prior Publication Data

US 2013/0298450 A1 Nov. 14, 2013

Related U.S. Application Data

(63) Continuation of application No. 13/298,342, filed on Nov. 17, 2011, now Pat. No. 8,491,676, which is a continuation of application No. 12/474,227, filed as application No. PCT/US2007/088252 on Dec. 19, 2007, now Pat. No. 8,062,388, and a continuation-in-part of application No. 11/290,596, filed on Dec. 1, 2005, now Pat. No. 7,745,382.

(60) Provisional application No. 60/644,494, filed on Jan. 18, 2005.

(51) Int. Cl.
*C10L 1/10* (2006.01)

(52) U.S. Cl.
USPC ..... 44/300; 44/324; 44/370; 44/439

(58) Field of Classification Search
USPC ..... 44/324, 370, 439, 300
See application file for complete search history.

(56) References Cited

U.S. PATENT DOCUMENTS

| | | | |
|---|---|---|---|
| 3,406,419 | A | 10/1968 | Young |
| 3,984,599 | A | 10/1976 | Norton |
| 4,127,491 | A | 11/1978 | Reick |
| 4,131,551 | A | 12/1978 | Thompson et al. |
| 4,218,330 | A | 8/1980 | Shubkin |
| 4,224,173 | A | 9/1980 | Reick |
| 4,228,021 | A | 10/1980 | Lenack |
| 4,375,418 | A | 3/1983 | Zoleski et al. |
| 4,443,348 | A | 4/1984 | Wright et al. |
| 4,504,404 | A | 3/1985 | Schumacher et al. |
| 4,534,873 | A | 8/1985 | Clark |
| 4,844,825 | A | 7/1989 | Sloan |
| 4,859,359 | A | 8/1989 | DeMatteo et al. |
| 4,946,510 | A | 8/1990 | Kinnebrew et al. |
| 4,956,122 | A | 9/1990 | Watts et al. |
| 5,120,358 | A | 6/1992 | Pippett |
| 5,136,118 | A | 8/1992 | Buchanan et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,631,211 | A | 5/1997 | Nakagawa et al. |
| 5,672,572 | A | 9/1997 | Araik et al. |
| 5,681,797 | A | 10/1997 | Lawate |
| 5,741,764 | A | 4/1998 | Patel et al. |
| 5,885,942 | A | 3/1999 | Zhang et al. |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,323,162 | B1 | 11/2001 | Yasunori et al. |
| 6,413,916 | B1 | 7/2002 | Baumgart et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro |
| 6,962,895 | B2 | 11/2005 | Scharf et al. |
| 6,992,049 | B2 | 1/2006 | Deckman et al. |
| 7,018,960 | B2 | 3/2006 | Negoro et al. |
| 7,022,766 | B2 | 4/2006 | Okada et al. |
| 7,055,534 | B2 | 6/2006 | Goode et al. |

(Continued)

FOREIGN PATENT DOCUMENTS

| | | | |
|---|---|---|---|
| DE | 19723460 | A1 | 1/1998 |
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| FR | 2193080 | | 7/1972 |
| JP | 59204700 | | 11/1984 |
| JP | 07233001 | | 9/1995 |
| JP | 2001-271077 | A | 10/2001 |
| WO | 9719153 | | 5/1997 |
| WO | 0234867 | A1 | 5/2002 |
| WO | 03064571 | A1 | 8/2003 |
| WO | 2006-015800 | A1 | 2/2006 |
| WO | 2006100188 | A1 | 9/2006 |
| WO | 2007004789 | A1 | 1/2007 |
| WO | 2009078882 | A1 | 6/2009 |

(Continued)

OTHER PUBLICATIONS

Rudnick, Leslie R., Ed., Synthetic Mineral Oils and Bio Based Lubricants: Chemistry and Technology, Taylor & Francis (2006).

(Continued)

*Primary Examiner* — Cephia D Toomer
(74) *Attorney, Agent, or Firm* — Jay R. Yablon

(57) ABSTRACT

A diesel fuel lubricant as a replacement for sulfur lubrication in Ultra-Low and Low Sulfur Diesel fuels, the process for producing said lubricant, and the method of using said lubricant. This lubricant comprises alpha-olefins; low odor aromatic solvents; and at least one a base oil selected from the base oil group consisting of hydroisomerized high base oils and HT Severe Hydro-cracked Base Oils; as well as other ingredients. Also disclosed is a method for producing this lubricant.

4 Claims, No Drawings

(56) References Cited

U.S. PATENT DOCUMENTS

| | | | | |
|---|---|---|---|---|
| 7,109,152 | B1 | 9/2006 | Corby et al. | |
| 7,124,728 | B2 | 10/2006 | Carey et al. | |
| 7,745,382 | B2 | 6/2010 | Sloan | |
| 7,931,704 | B2 | 4/2011 | Sloan | |
| 8,022,020 | B2 | 9/2011 | Sloan | |
| 8,039,424 | B2 | 10/2011 | Sloan | |
| 8,062,388 | B2 * | 11/2011 | Sloan | 44/324 |
| 8,071,513 | B2 | 12/2011 | Sloan | |
| 8,071,522 | B2 | 12/2011 | Sloan | |
| 8,268,022 | B2 | 9/2012 | Sloan | |
| 8,334,244 | B2 | 12/2012 | Sloan | |
| 8,377,861 | B2 | 2/2013 | Sloan | |
| 8,415,280 | B2 | 4/2013 | Sloan | |
| 8,491,676 | B2 * | 7/2013 | Sloan | 44/324 |
| 2003/0040444 | A1 | 2/2003 | Garmier | |
| 2003/0087769 | A1 | 5/2003 | Dituro et al. | |
| 2004/0014613 | A1 | 1/2004 | Dituro et al. | |
| 2004/0060229 | A1 | 4/2004 | Todd et al. | |
| 2004/0077506 | A1 | 4/2004 | Arrowsmith et al. | |
| 2006/0160708 | A1 | 7/2006 | Sloan | |
| 2008/0182769 | A1 | 7/2008 | Sloan | |
| 2008/0190014 | A1 | 8/2008 | Volkel et al. | |
| 2010/0269404 | A1 | 10/2010 | Sloan | |
| 2010/0273687 | A1 | 10/2010 | Sloan | |
| 2010/0273688 | A1 | 10/2010 | Sloan | |
| 2011/0009301 | A1 | 1/2011 | Sloan | |
| 2011/0015103 | A1 | 1/2011 | Sloan | |
| 2011/0197499 | A1 | 8/2011 | Sloan | |
| 2012/0035087 | A1 | 2/2012 | Sloan | |
| 2012/0060410 | A1 | 3/2012 | Sloan | |
| 2012/0077720 | A1 | 3/2012 | Sloan | |
| 2012/0077724 | A1 | 3/2012 | Sloan | |
| 2013/0157918 | A1 | 6/2013 | Sloan | |
| 2013/0178403 | A1 | 7/2013 | Sloan | |

FOREIGN PATENT DOCUMENTS

| | | | |
|---|---|---|---|
| WO | 2009079020 | A1 | 6/2009 |
| WO | 2009085957 | A1 | 7/2009 |
| WO | 2009085967 | A1 | 7/2009 |
| WO | 2012-040153 | A2 | 3/2012 |
| WO | 2012-040153 | A3 | 3/2012 |

OTHER PUBLICATIONS

Journal of Automotive Engineering, May 1, 2001, vol. 55, No. 5, pp. 67-72.

Journal of Automotive Engineering, May 1, 2001, vol. 55, No. 5, pp. 67-72, English translation of: p. 70, last paragraph; Figures 6 and 7.

Kioupis, L.I. ; Maginn, E.J., Molecular simulation of poly-(alpha)-olefin synthetic lubricants: Impact of molecular architecture on performance properties, Journal of Physical Chemistry B: Materials, Surfaces, Interfaces, amp Biophysical; Journal vol. 103; Journal Issue: 49; Dec. 9, 1999.

* cited by examiner

UNIVERSAL SYNTHETIC DIESEL FUEL ADDITIVE PRODUCT-BY-PROCESS TO REPLACE THE LOST SULFUR LUBRICATION WHEN USING LOW-SULFUR DIESEL FUELS

CROSS-REFERENCE TO RELATED APPLICATIONS

This application is a continuation of application U.S. Ser. No. 13/298,342 filed Nov. 17, 2011, now U.S. Pat. No. 8,491,676 issued Jul. 23, 2013. Said U.S. Ser. No. 13/298,342 is a continuation of application U.S. Ser. No. 12/747,227 filed Jun. 10, 2010, now U.S. Pat. No. 8,062,388 issued Nov. 22, 2011. Said U.S. Ser. No. 12/747,227 is a U.S. national stage application based on expired PCT/US07/88252 filed Dec. 19, 2007. Said U.S. Ser. No. 12/747,227 is also a continuation-in-part of U.S. Ser. No. 11/290,596 filed Dec. 1, 2005, now U.S. Pat. No. 7,745,382 issued Jun. 29, 2010. Said U.S. Ser. No. 11/290,596 claims priority benefit of expired provisional application U.S. 60/644,494 filed Jan. 18, 2005.

FIELD OF THE INVENTION

The field of invention relates to the latest technology in the development of a replacement synthetic lubricant to accommodate the dramatic reduction in sulfur content in Ultra-Low and Low Sulfur Diesel fuels.

BACKGROUND OF THE INVENTION

Over the years diesel fuels have been subject to environmental pressures to have the lubrication factor (sulfur) dramatically reduced or eliminated. Sulfur has played a major role in the lubrication of mechanical parts within the fuel system of the diesel engines. Ultra-Low Diesel Fuel, which is limited to 15 PPM of sulfur, was proposed by the EPA as a new standard for the sulfur content in on-road diesel fuel sold in the United States since Oct. 15, 2006, except for California and rural Alaska. California has required this since Sep. 1, 2006 and rural Alaska will transition to all diesel to Ultra Low Sulfur diesel by 2010. The new regulation applies to all diesel fuel and diesel fuel additives and distillate fuels blended, and to diesel for on-road use, such as kerosene. By Dec. 1, 2010, all highway diesel will be Ultra-Low Sulfur Diesel. Non-road diesel will transition to 500-PPM sulfur in 2007 (Low sulfur diesel) and to Ultra-Low sulfur Diesel by 2010. Locomotives and marine diesel will also transition to 500 PPM of Sulfur in 2007, and to Ultra-Low sulfur diesel by 2012. Prior to October 1993, Sulfur Content in Diesel fuel was 5000 PPM allowing sufficient lubrication to moving parts such as fuel Pumps, Injectors and valves etc. With this dramatic reduction of Sulfur, necessary lubrication has diminished to the point of premature wear becoming a major problem in the diesel mechanical industry.

SUMMARY OF THE INVENTION

Disclosed herein is a diesel fuel lubricant as a replacement for sulfur lubrication in Ultra-Low and Low Sulfur Diesel fuels, the process for producing said lubricant, and the method of using said lubricant. This lubricant comprises alpha-olefins; low odor aromatic solvents; and at least one a base oil selected from the base oil group consisting of hydroisomerized high base oils and HT Severe Hydro-cracked Base Oils; as well as other ingredients. Also disclosed is a method for producing this lubricant.

DETAILED DESCRIPTION

The invention relates to the use of a replacement diesel fuel lubricant additive for Ultra-Low and Low Sulfur Diesel which that can be added to fuels to replace the dramatic loss of lubrication generally associated with higher sulfur content in diesel fuels. The product will have utility in all forms of diesel engines or turbines where sulfur was an integral component of internal lubrication. The invention has been submitted by confidential disclosure to the EPA and has received registration under 40CFR 79.23 in October 2007.

Previous diesel fuel additives relied on the concentrated dosage of sulfur in diesel fuels, which is now highly restricted by the United States Environmental Protection Agency and various foreign governments. With the new universal environmental standards, sulfur in diesel is limited to on-road application of 15-PPM. On certain marine and locomotive transports, a limited time allowance of 500-PPM is granted for change over to ultra-low sulfur diesel.

Primary Ingredients

The finished product (preferred embodiment of the invention) is a combination of:

- Alpha-Olefins: This is a primary ingredient also known as Alkenes, Polymerized, Chlorowax Liquids, and Chlorinated Paraffins whose carbon chain length are 12 to 24 with chloric weight percentage from 21.4 to 70%, an HCl of 4 to 10 ppm and molecular weight of 273.5 to 650 and Wt. Cl (2) from 20 to 70% with specific gravity at 25 degrees centigrade of 1.050 to 1.50 and a JQD weight percentage of HCL being 0.20 to 0.60 maximum. The primary use is for the above ingredient is for lubricant formulations, lubricant additive compounds, extreme-pressure additive formulations and for metal working compounds. Further, alpha-olefins or associated products reduce the growth of algae in fuel as aging or excessive moisture accumulates and stabilize the fuel over time while providing extreme lubrication to the fuel system and the firing chamber of the engine. This provides the lubrication lacking in ultra low sulfur diesel.
- Low Odor Aromatic Solvents: This is a primary ingredient which is a highly-refined, low toxic, low-odor solvent ideal for paints, varnishes, food grade coatings, adhesives, diluents, thinners, agrochemicals, household pesticides, spray oils and specialty chemicals. Aromatic percentage is 5 to 40% (EC-A-G04), a flash point of 20 to 80 degrees centigrade (ASTM D-93) and a density at 30 degrees centigrade (plus/minus) 0.600 to 0.900 (ASTM D-4052).
- Hydroisomerized High-Base Oils or HT Severe Hydrocracked Base Oils: This primary ingredient is a severe hydro-cracked or hydroisomerized base oil with low or no aromatics and impurities achieved by chemically reacting the feed stock with hydrogen to reduce or remove polar compounds containing sulphur, nitrogen and oxygen and to convert aromatic hydrocarbons to saturated cyclic hydrocarbons breaking up the heavy polycyclo-paraffin molecules to light saturated hydrocarbons. This may include fractionated oils that have been hydro-finished or hydro-polished. The base oils can be used in a host of lubricating oils, motor oils, cutting oils, food processing, pharmaceutical, industry, agriculture lubricants and extreme pressure additives. These add to the lubrication of ultra low sulfur diesel fuel.

Other Ingredients

- Cetane Booster, Detergent, Cloud Point and Wax Reducer Blend: In accordance with this invention, this is a blend comprising: 2-Ethylhexyl Nitrate with suggested percentage of 10 to 30% by weight and CAS No. 27247-96-7, which is the primary ingredient of this blend. Petroleum Naphtha—Suggested percentage from 50 to 70% by weight and CAS 64742-94-5. Naphthalene with suggested percentage of 5 to 7% by weight and CAS No. 91-20-3. Trimethylbenzene with suggested percentage of 1 to 7% by weight with a CAS of 25551-13-7. This group of compounds when blended together cleans and maintains the firing chamber of the engine, increase the British Thermal Units of the fuel and reduce the massing of the wax crystals within the fuel.

Synthetic Calcium Sulfonates: An over-based synthetic calcium sulfonate with a TBN of 100 to 600 whose primary purpose is for extreme pressure additive formulations offering corrosion protection, dispersants and detergency in oil soluble additives for ferrous and non-ferrous metals with a minimum calcium weight of 10.00 to 20.00%, a total base number, mg KOH/g (ASTM D-2896) of 200 to 600 and an average molecular weight (ASTM d-3712) of 800 to 1200. Important note: in December 2007, a new United States law was enacted which may restrict the future use of calcium sulfonates in fuel additives, and so at least the United States, it may become necessary to omit this ingredient from the invention. This is possible, because the 2-Ethylhexyl Nitrate above serves a similar corrosion protection, dispersant and detergency function.

Low Flash Mineral Spirits: Referred to as Stoddard Solvent and/or White's Spirits, and is commonly used as an extraction solvent, cleaning solvent, solvent in aerosols, paints, lacquers, varnishes and paint thinners for household and commercial use and has been subjected to hydrodesulfurization solvent extraction with a mixture of saturated aliphatic and alicyclic C7-C12 with a maximum of 40%. The flash point ranges from 15 to 40 degrees centigrade, aniline point of 50 to 80 degrees centigrade, vapor density of 3.5 to 6.0 (air be 1) and viscosity (cps. 25 degrees centigrade) 0.70 to 1.75. As a cleaning solvent it cleans components within the fuel system.

Solvent activated dyes: These are commonly-used to identify grades or designated uses of fuels and lubricants. They are produced in both powder and liquid form and when introduced to the product are stable and leave an identifiable color to the product.

Pour Point Depressants or Cloud Point Depressants: These are used to reduce agglomeration or massing together of wax crystals in paraffin compounds such as lubricants and diesel fuel.

Isomer Reformate: Also referred to as a Solvent, Toluene, Toluol, Methylbenzene and Phenylmethane with a chemical formula of C7H8 (C6H5CH3) and a CAS No. 108-88-3, a molecular weight of 90.00 to 95.00 g/mole and a specific gravity of 0.800 to 0.900 (water being 1). The chemical is an aromatic hydrocarbon that is widely used as an industrial feedstock and as a solvent for cleaning the fuel systems, holding tanks and the combustion chamber of the engine.

Dimethyl Ketones: Also referred to as Acetone. It is colorless, has low boiling point, and is miscible in proportions with water, alcohols, most hydrocarbons and other organic liquids including diesel fuel stocks to help clean and reduce carbon build up on valves and piston tops.

Preferred Blending Ratios

The preferred blending Ratios for each component are shown as below. It is important to maintain a blend of component that fall within the following percentages. Note that in the event one or more of the ingredients shown below is omitted from the diesel fuel additive, the percentages by weight of the remaining ingredients are proportionately increased:

Alpha-Olefins: 5 to 30% by weight and preferably 7.0 to 25% by weight and more preferably 9.0 to 18% by weight. Most preferable is 11.0% by weight.

Low Odor Aromatic Solvents: 3.0 to 27% by weight and preferably 5.0 to 22% by weight and more preferably is 7.0 to 18% by weight. Most preferable is 15.0% by weight.

Hydroisomerized High-Base Oils and HT Severe Hydrocracked Base Oils: 0.50 to 15 percent by weight and preferably 0.75 to 10% by weight and more preferably 2.0 to 8.0% by weight. Most preferable is 5.0% by weight.

Cetane Booster, Detergent, Cloud Point and wax Reducer Blend: 0.03 to 0.25% by weight and preferably 0.05 to 0.20% by weight and more preferably 0.09 to 0.17% by weight. Most preferable is 0.13% by weight.

Synthetic Calcium Sulfonates: 0.05 to 0.25% by weight, preferably 0.07 to 0.20% by weight and more preferably 0.10 to 0.18% by weight. Most preferable is 0.12% by weight.

Low Flash Mineral Spirits: 15 to 50% by weight and preferably 20 to 45% by weight and more preferably 25-39% by weight. Most preferable is 35% by weight.

Solvent Activated Dyes: 0.002 to 0.005 percent by weight and preferably 0.0025 to 0.004% by weight and more preferably 0.027 to 0.035% by weight. Most preferable is 0.003 percent by weight.

Pour Point Depressants or Cloud Point Depressants: 0.50 to 2% by weight and preferably 0.65 to 1.75% by weight and more preferably 0.75 to 1.35% by weight. Most preferable is 1% by weight.

Isomer Reformate: 0.50 to 5.0% by weight and preferably 0.75 to 4.0% by weight and more preferably 1.0 to 3.0% by weight. Most preferable is 2.0% by weight.

Dimethyl Ketones: 10 to 50% by weight and preferably 17 to 40% by weight and more preferably 24 to 36% by weight. Most preferable is 30%.

Preferred Sequence of Blending Components

The initial blend (primary blend) will require the Poly Alpha Olefins, the Low Aromatic Solvent and the Base Oil being blended until the liquid is a consistent amalgamation without any appearance of separation. Blending is based on speed of the agitator and temperature will dictate the amount of time for the blend to complete. The blending time range may vary from 4 to 6 hours. The ideal temperature for each component is between 22 to 30 degrees centigrade for ideal blending. While this is blending, a secondary blend for the Cetane Booster, Detergent and Cloud Point Reducer can be prepared in a smaller high speed enclosed blender, and then added to the main blend.

If the synthetic calcium sulfonates are employed (noting the recent U.S. law which could restrict their use in the U.S.), blending will require that the synthetic calcium sulfonates be blended with the mineral spirits in an approximate 50/50 ratio in the initial stage of the blend to produce a tertiary blend. (The mineral spirits used will be from the preferred percentage set forth earlier.) This tertiary blend, or the mineral spirits alone absent the synthetic calcium sulfonates, together with the balance of the ingredients, can be then added to the main blend and the agitator is run until the components appear to have thoroughly blended into a consistent liquid.

Preferred Blend Equipment

The Process sequence involves a series of blending and holding tanks where the product can be weighed and then pumped through control valves to maintain consistent flow and pressure. The blending should be performed in a enclosed tank to reduce product evaporation (loss) and prevent exposure to open spark. Blending equipment can be by a combination of high or low speed blending apparatus. Size or volume of tank is not critical to the blend.

Universal Use of Invention

The product has been put to experimental test in various on-road and off-road vehicles and has demonstrated that when added at 2 to 3 ounces per 10 gallons of either ultra-low and low sulfur diesels, reduced wear, increased mileage and reduced emissions have been experienced, as summarized below.

Testing Procedures

The latest method for testing wear with the Ultra-Low and Low Sulfur Diesel fuels is the High Frequency Reciprocating Rig (HFRR). ASTM-D 975. The fuel is subjected to wear test and must demonstrate a wear scar size of no more than 520 microns.

Test Results

Although all the diesel fuels tested exceeded the allowable wear by as much a 20 to 30 microns, the addition of the invention added to the Ultra-Low sulfur diesel (2.0 ounces per 10 gallons of diesel fuel) resulted in the wear scar being reduced by some 28 percent of the allowable scar size or approximately 375 microns.

This experimental testing has demonstrated the ability of the invention to dramatically reduce wear that is currently being experienced by diesel mechanical equipment. As further test ASTM standards are developed for Ultra-Low Sulfur diesel, further experimental tests will be conducted with the invention.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A synthetic diesel fuel additive product-by-process, produced by a method comprising:

blending alpha-olefins, low odor aromatic solvents, and at least one base oil until the blend is a consistent amalgamation without any appearance of separation, thereby producing a primary blend; and blending a cetane booster, detergent, cloud point reducer blend, thereby producing a secondary blend;

adding said secondary blend to said primary blend; and adding low flash mineral spirits to said primary blend and said secondary blend.

2. The product-by-process of claim 1, said method further comprising:

separately blending calcium sulfonates and said low flash mineral spirits, thereby producing a tertiary blend; and adding said low flash mineral spirits by adding said tertiary blend to said primary and secondary blend.

3. The product-by-process of claim 1, said method further comprising:

adding solvent activated dyes; at least one depressant selected from the group consisting of pour point depressants and cloud point depressants; isomer reformate; and dimethyl ketones to said blend of primary and secondary blends, and said low flash mineral spirits.

4. The product-by-process of claim 2, said method further comprising:

adding solvent activated dyes; at least one depressant selected from the group consisting of pour point depressants and cloud point depressants; isomer reformate; and dimethyl ketones to said primary, secondary, and tertiary blends.

* * * * *